United States Patent [19]

Michatek

[11] 4,245,831

[45] Jan. 20, 1981

[54] ADJUSTABLE TRAY

[75] Inventor: Stephen F. Michatek, LeRoy, N.Y.

[73] Assignee: Eastman Kodak Company, Rochester, N.Y.

[21] Appl. No.: 6,719

[22] Filed: Jan. 26, 1979

[51] Int. Cl.[3] ..... B65H 1/00

[52] U.S. Cl. ..... 271/171; 271/240

[58] Field of Search ..... 271/171, 240; 226/196, 226/199

[56] References Cited

U.S. PATENT DOCUMENTS

| | | | |
|---|---|---|---|
| 3,104,873 | 9/1963 | Benson . | |
| 3,369,804 | 2/1968 | Schulze . | |
| 3,406,964 | 10/1968 | Eichorn . | |
| 3,476,382 | 11/1969 | Tregay . | |
| 3,524,574 | 8/1970 | Potynski | 226/199 X |
| 3,575,331 | 4/1971 | Middleman | 226/199 |
| 3,617,048 | 11/1971 | Albert | 271/171 X |
| 3,715,117 | 2/1973 | DiFulvio . | |
| 3,807,725 | 4/1974 | Bookless . | |
| 3,851,811 | 12/1974 | Turner | 226/199 |
| 3,921,972 | 11/1975 | Miller . | |
| 3,957,366 | 5/1976 | Taylor . | |

FOREIGN PATENT DOCUMENTS 1492466 11/1977 United Kingdom .

*Primary Examiner*—Richard A. Schacher
*Attorney, Agent, or Firm*—G. Herman Childress

[57] ABSTRACT

A tray receives and guides document sheets that are being manually fed to a copier/duplicator or the like. The tray has a plurality of flexible segments movable in pairs to adjust the size of a guide surface so that sheets of several sizes can be accommodated by the tray.

6 Claims, 6 Drawing Figures

FIG. 1
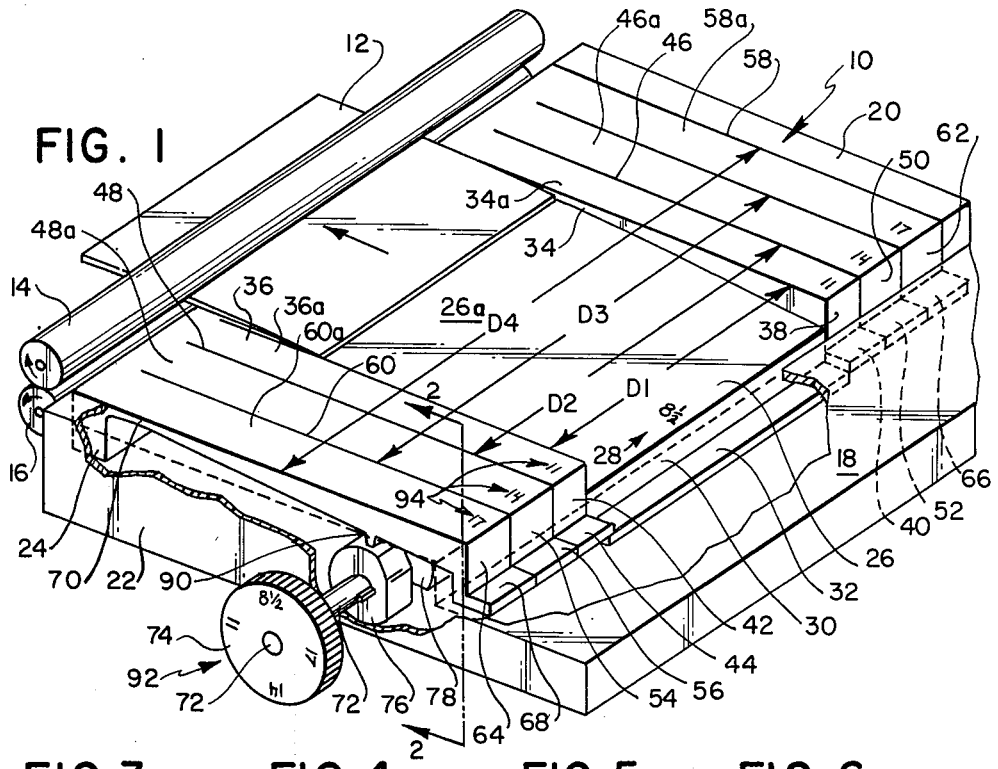
FIG.3
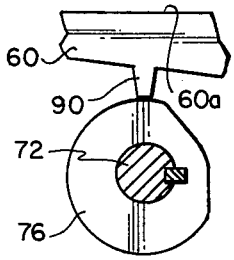
FIG.4
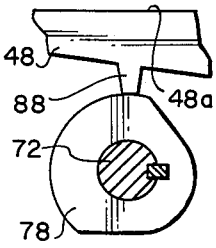
FIG.5
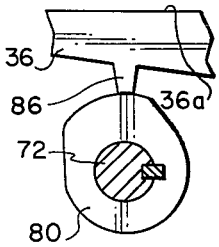
FIG.6
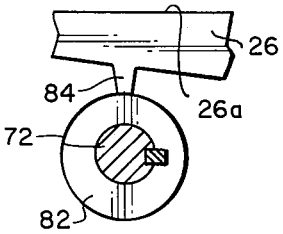
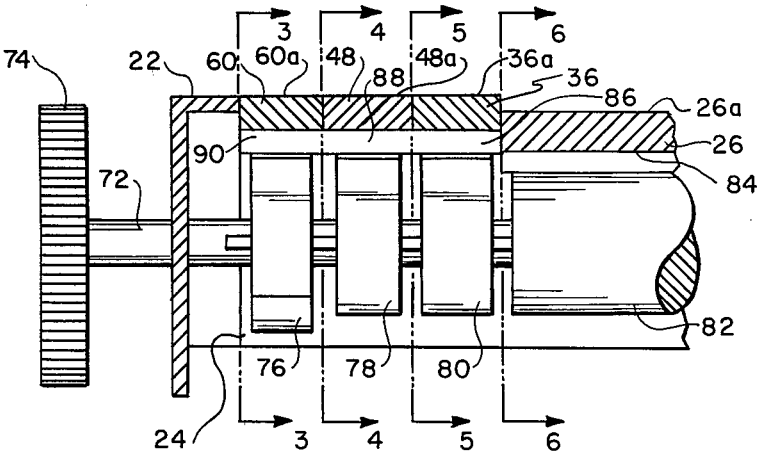
FIG.2

ADJUSTABLE TRAY

FIELD OF THE INVENTION

This invention relates to trays for guiding sheets into a copier/duplicator or the like and, more particularly, to such a tray which is adjustable to accommodate and guide document sheets of various sizes.

DESCRIPTION OF THE PRIOR ART

Sheet trays and guide apparatus for document sheets, copy sheets and the like in copier/duplicators or other types of sheet handling apparatus are well known. While some sheet guides or trays are adapted to handle only one size sheet, it is also well known to provide adjustable side guides so that sheets of various sizes can be accommodated. In some apparatus only a single side guide is adjustable, and in other apparatus both side guides are simultaneously adjustable toward and away from each other so that the sheets are always aligned along a particular feed axis. Sometimes adjustment of the side guides is accomplished by the operator grasping the guide and moving it. In other apparatus the guides are adjusted from a remote position by rotating cranks or the like. Typical guide means as described above are disclosed in U.S. Pat. Nos. 3,104,873; 3,369,804; 3,406,964; 3,476,382; 3,715,117; 3,807,725; 3,921,972; and 3,957,366; and in British Pat. No. 1,492,466.

The mechanical apparatus required for sheet guides to function properly may be expensive and may adversely affect the appearance of the apparatus. In addition, when the sheets are to be fed along a central axis and both side guides are to be adjusted simultaneously, then a substantial number of pieces may be required in order to assemble the sheet guiding apparatus.

SUMMARY OF THE INVENTION

In accordance with the present invention an adjustable width sheet input tray is provided for guiding sheets toward a document copier and the like. The tray comprises a plurality of separate segments positioned adjacent each other. Means are provided for adjusting the position of at least one segment relative to an adjacent segment between a first position wherein the segments are located to jointly form a guide surface along which sheets are advanced and a second position wherein one of the segments is offset from the adjacent segment, thereby to vary the size of the guide surface.

BRIEF DESCRIPTION OF THE DRAWINGS

In the detailed description of the preferred embodiment of the invention presented below reference is made to the accompanying drawings in which:

FIG. 1 is a perspective view illustrating a tray of the present invention incorporated in copier/duplicator apparatus;

FIG. 2 is an enlarged, fragmentary section taken along line 2—2 in FIG. 1; and FIGS. 3–6 are fragmentary sections taken along lines 3—3, 4—4, 5—5, and 6—6 in FIG. 2.

DESCRIPTION OF THE PREFERRED EMBODIMENT

The tray of the invention is generally designated 10 and is adapted to receive and guide a sheet 12 into an exposure station of a copier/duplicator or the like. The tray can be used with various types of apparatus. For example, the tray can be adjacent a pair of drive rollers 14 and 16 which jointly define a nip that receives the sheet 12 and advances it toward an exposure station, such as a platen (not shown) of a copier. Sheet 12 is moved into the nip of rollers 14 and 16 manually and should be located so that the center line of the length of the sheet is aligned with the transverse center of rollers 14 and 16. The rollers are aligned with the platen so that the sheet is delivered to the center of the platen on the copier. The tray of the present invention insures proper positioning of the sheets 12 as they are fed into the nip rollers and thereby assures proper positioning of the sheets on the platen of the copier.

Tray 10 is positioned adjacent to a housing 18 at the top of the copier and between a pair of stationary side guides 20 and 22, the guide 22 being partially broken away in FIG. 1 in order to better illustrate the construction of the tray 10.

Tray 10 has a base portion 24 located adjacent rollers 14 and 16 and secured rigidly to the frame of the copier. Base 24 extends the entire length of the tray and is the only portion thereof that is fixed to the copier. The other parts of the tray are free to flex as explained later.

The tray has a central portion 26 that is located in the center of the tray and extends from the base portion 24 away from the rollers 14 and 16. The central portion has an upper guide surface **26*a* along which sheets 12 are adapted to be moved toward the nip between rollers 14 and 16. Surface 26*a* is illustrated as being flat but can be provided with elongate grooves extending in the direction of movement of the sheet 12 in order to facilitate movement of the sheet. Central portion 26 of the tray has a width dimenson D1 that is equal to one dimension of a sheet 12 that is to be guided along surface 26*a* to the copier platen. For example, the dimension D1 may be equal to the length of the sheet 12. The length of dimension D1 can be marked on surface 26*a* as shown by the indicia designed 28**.

The end of the central portion opposite from the base 24 is designated 30 and it extends downwardly from surface **26*a* and along the edge of the housing 18. At the bottom of end 30 there is a flange 32 that projects outwardly and is at least partially located beneath the housing 18**.

Tray 10 further comprises a pair of elongate tray segments 34 and 36 that extend from base portion 24. Segments 34 and 36 are generally finger-like in configuration, the segment 34 being located along one side edge of the central portion 26 and segment 36 being located along the opposite side edge of the central portion. Segment 34 has an upper surface **34*a* that forms part of the guide surface for a sheet as explained later. The segment comprises an end 38 opposite from base 24 which extends downwardly from surface 34*a* and lies adjacent to housing 18. A flange 40 at the bottom of end 38 lies at least partially beneath the housing 18. Similarly the other segment 36 of the pair includes an upper guide surface 36*a*, and end 42 opposite from base 24, and a flange 44 which lies partially beneath the housing 18**.

Another pair of tray segments 46,48 have upper surfaces **46*a* and 48*a*, respectively, that are located along side the segments 34 and 36. Segment 46 has an end 50 located along side housing 18 and an outwardly projecting flange 52 that is at least partially positioned beneath the housing 18. In like manner the segment 48 has an end 54 and a flange 56 located partially beneath housing 18. Finally, another pair of tray segments 58 and 60 extend along side the segments 46 and 48. The segments 58, 60 have upper guide surfaces 58***a* and 60*a*, ends 62 and 64, and outwardly projecting flanges 66 and 68, respectively which extend beneath the housing 18.

Preferably, the tray is made of a material which allows each of the segments 34, 36, 46, 48, 58 and 60 to flex between each of two positions, i.e., a raised position illustrated in the drawings and a lowered position (not shown) wherein the upper surfaces of the segments can be aligned with the surface 26*a* of the central portion 26 to form a continuation thereof and thereby accommodate documents 12 of various dimensions. By way of example, the tray can be made from polycarbonate plastic material and each of the segments and the central portion can be joined to the base 24 by a relatively thin web-like connection as shown at 70 in FIG. 1 for the segment 60. This web-like connection between the various segments and the base portion allows the segments to flex up and down. Base 24 is connected to the copier so that the segments and the central portion would normally occupy positions at or slightly below the position illustrated in FIG. 1 for the central portion 26 of the tray. However, the flexible web-like connection 70 allows the various segments to be flexed upwardly from their normal position to occupy a second (elevated) position as illustrated in FIG. 1 of the drawings.

In the preferred embodiment illustrated in the drawings the various segments of the tray are moved from their normal (lower) position to their elevated position as shown in FIG. 1 by means of a series of cams. More specifically, a shaft 72 is mounted in the stationary guides 20 and 22 for rotation about an axis. The shaft can be rotated by manually turning a control knob 74 on one end of the shaft. Shaft 72 carries seven cams, four of which are illustrated in FIGS. 2–6 and designated 76, 78, 80 and 82. The three cams not illustrated are identical to cams 76, 78 and 80 and are used for moving segments 58, 46 and 34, respectively, as explained later. Also, while the cams have been illustrated as separate cam members, it will be understood that the various cam surfaces can be formed on a single cam block, if desired. The cams are secured to the shaft for rotation therewith by any suitable means, such as the keys illustrated in FIGS. 3–6.

On the lower surface of th central portion 26 and each of the six tray segments there is a cam follower which is adapted to engage one of the various cams on shaft 72. The followers for the central portion 26 and for segments 36, 38 and 60 are shown at 84, 86, 88 and 90, respectively, in FIGS. 2–6. While not illustrated in the drawings, similar cam followers are provided for controlling the position and movement of the tray segments 34, 46 and 58.

FIGS. 3–6 illustrate the shape of the cams 76–82. Assuming that the shaft 72 is rotated in a clockwise direction as viewed in FIGS. 3–6 through 360°, cam 76 is effective to hold the cam shaft segment 60 in an elevated position until the shaft rotates approximately 270° at which time the cam allows the tray segment 60 to flex downwardly to a position wherein its upper surface 60*a* is substantially parallel to the surface 26*a* of the central portion 26 of the tray. Similarly, cam 78 is shaped so that finger 48 is held in an elevated position until the shaft is rotated approximately 180° at which time the cam allows the segment 48 to flex downwardly until surface 48*a* thereof is substantially parallel to the surface 26*a* of the central portion. In like manner the cam 80 when rotated about 90° allows the segment 36 to flex downwardly until surface 36*a* is substantially parallel to the central portion 26*a*. Cam 82, on the other hand, is cylindrical and concentric with shaft 72 so that the central portion 26 remains in the same, lowered position throughout rotation of shaft 72. As noted previously, cams controlling the operation of segments 58, 46 and 34 are identical to the cams 76, 78 and 80, respectively. Therefor segments 34 and 36 are moved as a pair, segments 46 and 48 are moved as a pair, and segments 58 and 60 are moved as a pair. It will also be apparent that the innermost pair of segments 34 and 36 immediately adjacent to central portion 26 are lowered first, followed by the segments 46 and 48 and finally by the outermost pair of segments 58 and 60.

When an operator wishes to copy a document 12 having a length equal to or smaller than dimension D1, the cams controlling the position of the three pair of segments are located as illustrated in FIGS. 3–6 so that all of the segments are in their elevated position above the central portion 26 of the tray. Then the document is placed face down on surface 26*a* and moves across the surface and into the nip defined by rollers 14 and 16. The side edges of segments 34 and 36 adjacent surface 26*a* guide the document as it is moved along surface 26*a*. This also accurately centers a document of a predetermined dimension D1, such as a document 8½" in length. For documents smaller than D1, suitable indicia (not shown) can be provided on surface 26*a* to assist the operator in locating the document on the surface.

In order to lower tray segments 34 and 36 without lowering the other tray segments, knob 74 is rotated 90° clockwise, thereby rotating each of the cams on shaft 72. The cam 80 for segment 36 and the similar cam controlling the segment 34 allows both segments to flex downwardly until upper surfaces 34*a* and 36*a* are coplanar with the surface 26*a*. Tray segments 46, 48, 58 and 60 remain in the raised position. At this time the tray provides a surface of a dimension D2 comprising the sum of the widths of surfaces 26*a*, 34*a* and 36*a*. Dimension D2 is selected to accommodate another commonly available size of document sheets that frequently is fed to a copier, such as sheets that are 11" in length.

Rotation of the knob 74 clockwise by an additional 90° (180° from the position shown in FIG. 1) rotates cam 78 and the corresponding cam on the other end portion of the shaft 72 to a position where the tray segments 46 and 48 are allowed to flex until the upper surfaces 46*a* and 48*a* thereof are substantially coplanar with the tray surfaces 26*a*, 34*a* and 36*a*. This provides a wider, flat guide surface having a third dimension D3 which is wider than the dimension D1 and D2 and which is adapted to accommodate document sheets 12 of a third length such as 14". In a similar manner rotation of the knob 74, cam 76 and the cam for segment 58 by 270° from the original position (or 90° from a position just described) allows the tray segments 58 and 60 to flex downwardly until surfaces 58*a* and 60*a* are coplanar with the surfaces 26*a*, 34*a*, 36*a*, 46*a*, 48*a*. This provides one wide, flat continuous guide surface for document sheets of a fourth dimension D4, such as sheets that are 17" long. Rotation of the shaft 72 by 360° will return the three sets of segments to the raised position as illustrated in FIG. 1. In each of the various positions the opposed marginal edges of a sheet having a dimension $D_1$, $D_2$, $D_3$ or $D_4$ engage abutment surfaces formed by vertical edges of the segments or by side guides 20 and 22 to center and guide the sheets along the tray.

Suitable detents (not shown) can be provided for temporarily holding the shaft and cams in each of the four positions at 90° intervals. In addition, suitable indicia shown at 92 can be provided on the face of the knob 74 (or on the edge thereof) to indicate the maximum length of a document that can be accommodated on the flat guide surface when the knob is in each of its various positions. Corresponding indicia can be provided on the various tray segments as shown at 94. Thus the operator can immediately determine the maximum size of a sheet that can be accommodated by the tray for any particular setting of the knob and positioning of the tray segments.

While three pair of movable tray segments have been disclosed, more or fewer segments can be provided if desired for particular application of the invention. In addition, for infrequently used paper sizes guide lines or markings (not shown) can be provided on the upper surfaces of the various tray and toward the nip rollers. The projecting flanges for the various portions of the tray, such as flange 32, are closely adjacent to the lower surface of the housing 18 when the tray segments are in their raised position. This limits the upward travel of the various tray segments. In addition, a supporting surface (not shown) can be located beneath the projecting flanges so that the flanges rest on such a surface when the segments are in their respective lowered positions. This insures that the lowered segments are coplanar and reduces the accuracy and tolerances required in shaping the cam surfaces. In this case the cam surfaces could be slightly below the segments when they are lowered.

The foregoing description indicates that the various segments are integrally formed with base 24. If desired, the segments can be separate elements, pivoted at base 24, and separately urged toward their respective lowered position. Also, because the central position 26 of the tray remains lowered at all positions of rotation of the cam 82, the central position 26 cam be fixed in position and the cam 82 can be eliminated.

The invention has been described in detail with particular reference to preferred embodiments thereof, but it will be understood that variations and modifications can be effected within the spirit and scope of the invention.

I claim:

1. A paper input tray for a document copier or the like adapted to receive sheets of a plurality of sizes having different dimensions, the tray comprising:

means defining a first guide surface having first and second side edges along opposite sides thereof;

adjustable means comprising a plurality of elongate flexible tray segments positioned beside the first and second side edges of said first guide surface, each tray segment being movable between a first position and a second position, each tray segment having a second guide surface that is spaced above the first guide surface when the tray segment is in the first position and forms a continuation of the first guide surface when the tray segment is in its second position so that sheets having a dimension equal to or less than the dimension between the side edges of the first guide surface can be guided properly along the tray when the tray segments are in their respective first positions and larger sheets having a dimension equal to or less than the sum of the guide surfaces can be guided properly along the tray when the tray segments are in their respective second positions; and movable cam means engageable with each of said segments for moving said segments between their respective second positions and their respective first positions, said segments when in the first position being in a flexed condition and being biased toward the second position so that the segments can flex to the second position in response to movement of said cam means.

2. A paper input tray for a document copier or the like adapted to receive sheets of a plurality of sizes having different dimensions, the tray comprising:

means defining a first guide surface having first and second side edges along opposite sides thereof;

adjustable means comprising a plurality of pairs of elongate tray segments, one segment of each pair being beyond the first side edge of the first guide surface and a second segment of each pair being beyond the second side edge of the first guide surface, one pair of said segments being located adjacent to said first guide surface and all of the segments being flexible between a first position and a second position, each of said segments being biased toward its second position, each of the segments having a second guide surface that is spaced above the first guide surface when the segments are in their respective first positions and forms a continuation of the first guide surface when the segments are in their respective second positions so that sheets having a dimension equal to or less than the dimension between the side edges of the first guide surface can be guided properly along the tray when the tray segments are in their respective first positions and larger sheets having a dimenson equal to or less than the sum of the guide surfaces can be guided properly along the tray when the tray segments are in their respective second positions; and cam means engageable with said segments for controlling movement of said segments from their respective second positions to their respective first positions in a sequence beginning with the pair of segments most remote from said first guide surface and ending with the pair of segments nearest said first guide surface, whereby the size of the guide surface is adjusted in increments to accommodate sheets of a plurality of sizes.

3. A tray for guiding sheets of several different sizes, the tray having a central portion with the guide surface substantially equal in width to a dimension of one size of a sheet to be guided along the tray, a first pair of tray segments comprising a first segment located along one side of said surface and a second segment located along a second side of said surface, and a second pair of tray segments comprising a third segment located adjacent the side of the first segment that is opposite from said surface and a fourth segment located adjacent the side of the second segment that is opposite from said surface, each of said segments having an upper guide surface and being movable between a lowered position wherein its upper surface is substantially coplanar with said guide surface to form a continuation thereof and a raised position wherein its upper surface is above said guide surface of said central portion, and means for independently moving said segments in pairs between their respective lowered positions and raised positions with the second pair of segments being moved to the raised position before the first pair of segments is moved to the raised position whereby sheets of at least three different sizes can be accommodated on said surfaces by selective positioning of said segments in their lowered and raised positions.

4. The invention as set forth in claim 3 further comprising a third pair of segments comprising a fifth segment located adjacent said third segment and a sixth segment located adjacent said fourth segment, said fifth and sixth segments having upper guide surfaces and being movable between a lowered position wherein the upper surfaces are substantially coplanar with said guide surface to form a continuation thereof and a raised position wherein the upper surfaces are above said guide surface of said central portion, and said moving means comprising means for moving said third pair of segments between their lowered and raised positions with the third pair of segments being moved to the raised position before the second pair of segments is moved to the raised position.

5. The invention as set forth in claim 4 further comprising a pair of stationary guides located adjacent said fifth and sixth segments, said stationary guides having portions adjacent said fifth and sixth segments and extending above the upper surfaces of said fifth and sixth segments when such segments are in their respective lowered positions to define the maximum dimension of a sheet that can be guided along the tray.

6. The invention as set forth in claim 3 wherein said moving means comprises a plurality of cam surfaces, each of said cam surfaces being engageable with one of said segments, and means for moving said cam surfaces relative to said segments.

* * * * *